US005169276A

United States Patent [19]

Henderickson

[11] Patent Number: 5,169,276

[45] Date of Patent: Dec. 8, 1992

[54] GOLF BALL RETRIEVAL APPARATUS

[76] Inventor: Robert J. Henderickson, P.O. Box 792, Carson, Wash. 98610

[21] Appl. No.: 779,333

[22] Filed: Oct. 18, 1991

[51] Int. Cl.[5] ..... B60P 1/00

[52] U.S. Cl. ..... 414/440; 56/328.1; 171/63; 414/442; 414/501

[58] Field of Search ..... 56/328.1; 294/19.2; 171/141, 104, 105, 43, 85, 108, 86, 129, 101, 63, 64, 65; 414/434, 435, 436, 437, 438, 439, 440, 441, 442, 443, 501, 537

[56] References Cited

U.S. PATENT DOCUMENTS

| | | | |
|---|---|---|---|
| 2,729,046 | 1/1956 | Patterson | 414/440 X |
| 3,175,714 | 3/1965 | Wittek | 56/328.1 X |
| 3,362,551 | 1/1968 | Shoemaker | 414/440 |
| 4,066,179 | 1/1978 | Livingston | 414/440 |
| 4,270,614 | 6/1981 | Judy | 171/63 |
| 4,561,240 | 12/1985 | Moore et al. | 56/328.1 |
| 4,603,544 | 8/1986 | Hayhurst | 56/328.1 |

FOREIGN PATENT DOCUMENTS

| | | | |
|---|---|---|---|
| 85340 | 6/1920 | Switzerland | 56/328.1 |
| 1501961 | 8/1989 | U.S.S.R. | 56/328.1 |
| 870968 | 6/1961 | United Kingdom | 56/328.1 |
| 1116191 | 6/1968 | United Kingdom | 171/63 |

*Primary Examiner*—Frank E. Werner
*Attorney, Agent, or Firm*—Leon Gilden

[57] ABSTRACT

A rectilinear framework includes a plurality of rear wheels mounted to respective right and left axles, with the right axle including a rear axle pulley cooperative with a front pulley and drive belt to effect rotation of paddle wheels to traverse an underlying ground surface and project golf balls rearwardly along a chute structure onto associated fabric webs to contain the golf balls therewithin.

5 Claims, 4 Drawing Sheets

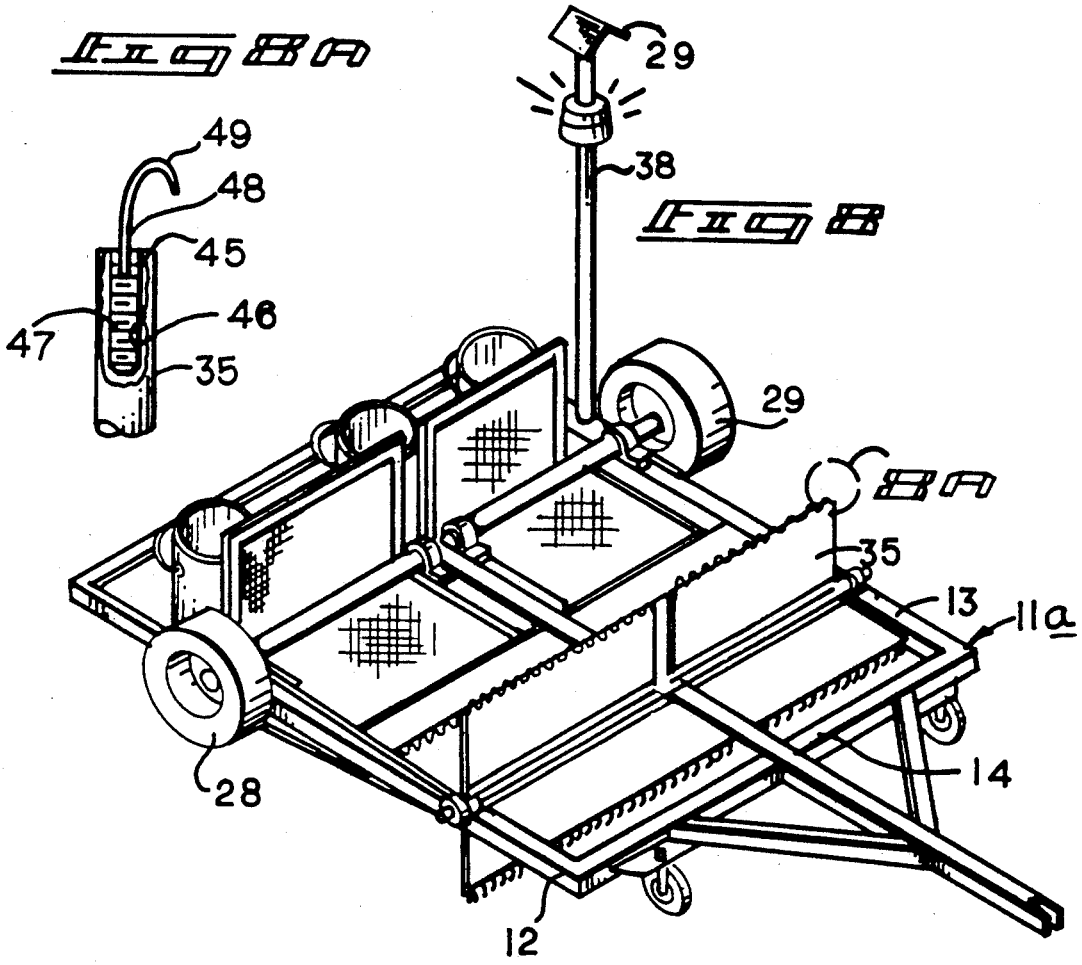
Fig 8A
49
48
45
46
47
35
Fig 8
29
38
29
8A
35
13
11a
14
28
12
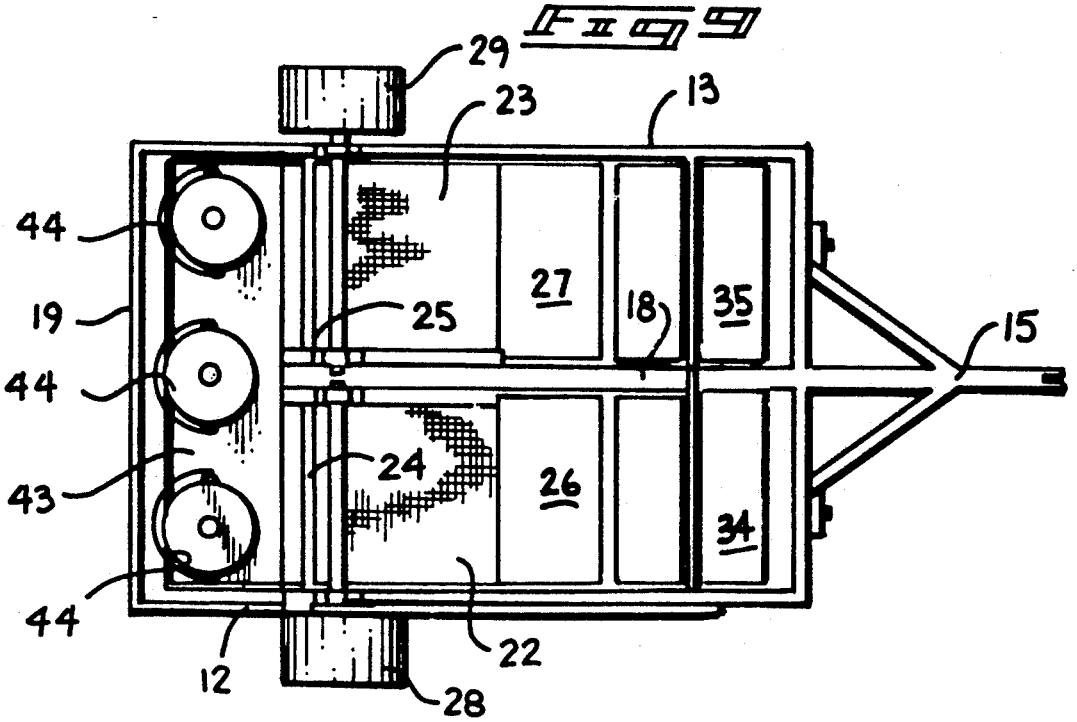
Fig 9
29
23
13
44
19
25
27
18
35
15
44
43
24
26
34
44
12
22
28

GOLF BALL RETRIEVAL APPARATUS

BACKGROUND OF THE INVENTION

1. Field of the Invention

The field of invention relates to golfing apparatus, and more particularly pertains to a new and improved golf ball retrieval apparatus wherein the same is arranged to project golf balls about a ground surface rearwardly onto receiving webs.

2. Description of the Prior Art

The retrieval of golf balls typically found at golf courses, such as in driving ranges and the like, is a labor intensive, time consuming procedure typically associated in maintenance of a golf course. Prior art ball retrieval apparatus of various types have been utilized, but have heretofore not been specifically directed into the unique arrangement to retrieve golf balls relative to a golf green. For example, U.S. Pat. No. 4,077,533 to Meyer sets forth a tennis ball retrieving apparatus wherein tennis balls are directed rearwardly along a chute structure into a rearwardly positioned basket.

U.S. Pat. No. 4,645,254 to Warden sets forth a portable golf ball retrieval tool wherein friction discs are arranged to engage golf balls therebetween.

U.S. Pat. No. 3,995,759 to Hollrock, et al. sets forth a further example of a golf ball retrieval apparatus to engage golf balls between opposed disc-type structure that are deflected to secure a golf ball therebetween.

As such, it may be appreciated that there continues to be a need for a new and improved golf ball retrieval apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of golf ball retrieval apparatus now present in the prior art, the present invention provides a golf ball retrieval apparatus wherein the same is arranged to project golf balls rearwardly along a chute into receiving web structure positioned rearwardly of the chutes or ramp organization as utilized. As such, the general purpose of the present invention, which will be described subsequently in greater detail, is to provide a new and improved golf ball retrieval apparatus which has all the advantages of the prior art golf ball retrieval apparatus and none of the disadvantages.

To attain this, the present invention provides a rectilinear framework includes a plurality of rear wheels mounted to respective right and left axles, with the right axle including a rear axle pulley cooperative with a front pulley and drive belt to effect rotation of paddle wheels to traverse an underlying ground surface and project golf balls rearwardly along a chute structure onto associated fabric webs to contain the golf balls therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf ball retrieval apparatus which has all the advantages of the prior art golf ball retrieval apparatus and none of the disadvantages.

It is another object of the present invention to provide a new and improved golf ball retrieval apparatus which may be easily and efficiently manufactured and marketed.

It is a further object of the present invention to provide a new and improved golf ball retrieval apparatus which is of a durable and reliable construction.

An even further object of the present invention is to provide a new and improved golf ball retrieval apparatus which is susceptible of a low cost of manufacture with regard to both materials and labor, and which accordingly is then susceptible of low prices of sale to the consuming public, thereby making such golf ball retrieval apparatus economically available to the buying public.

Still yet another object of the present invention is to provide a new and improved golf ball retrieval apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an isometric illustration of a modified framework structure utilized by the invention.

FIG. 8*a* is an orthographic cross-sectional view of section 8*a* as set forth in FIG. 8.

FIG. 9 is an orthographic top view of the framework structure as set forth in FIG. 8.

DESCRIPTION OF THE PREFERRED EMBODIMENT

Figure 1:
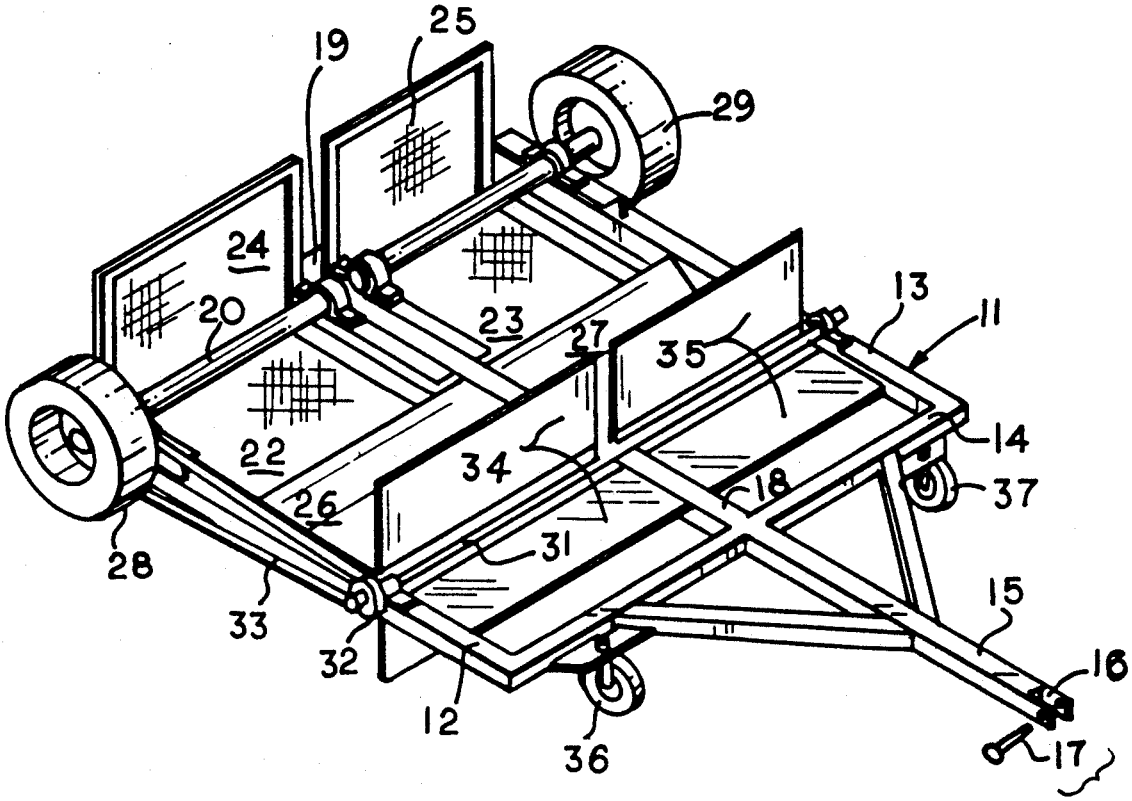
FIG. 1 is an isometric illustration of the instant invention.
Figure 2:
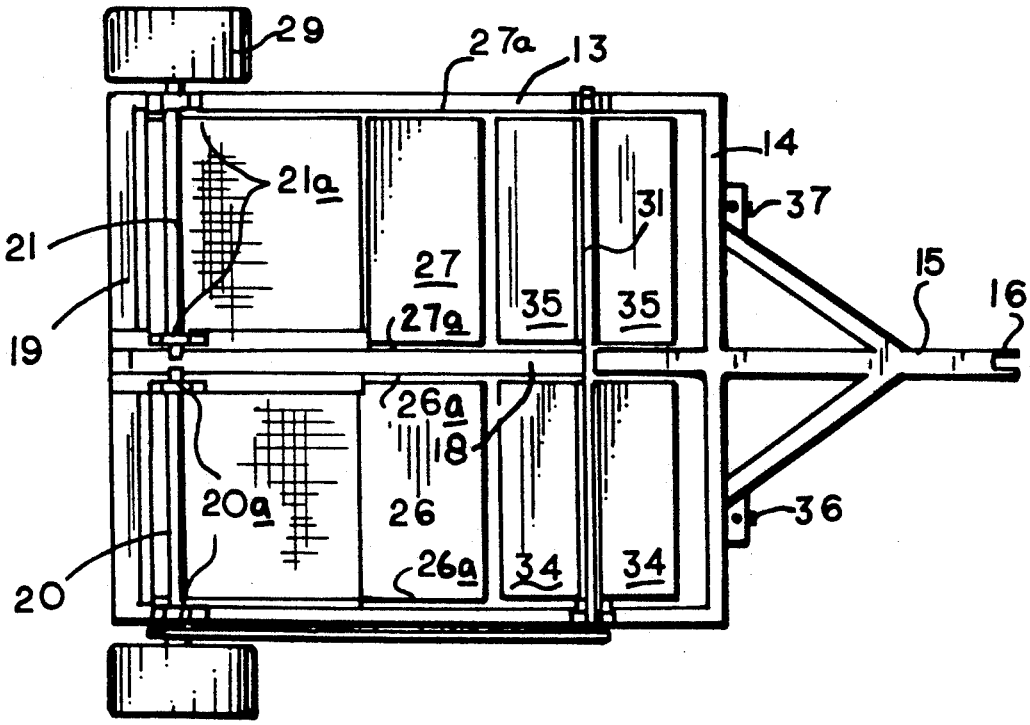
FIG. 2 is an orthographic top view of the instant invention.
Figure 3:
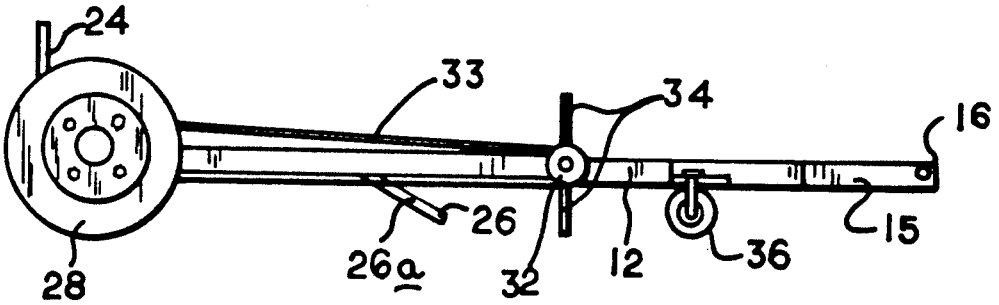
FIG. 3 is an orthographic side view of the instant invention.
Figure 4:
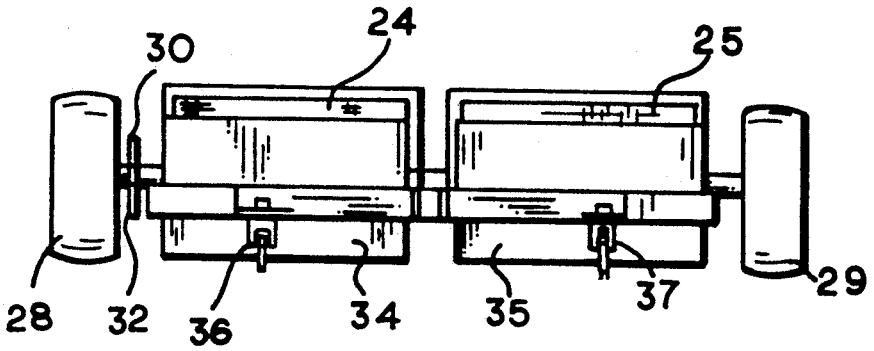
FIG. 4 is an orthographic frontal view of the instant invention.

With reference now to the drawings, and in particular to FIGS. 1 to 9 thereof, a new and improved golf ball retrieval apparatus embodying the principles and concepts of the present invention and generally designated by the reference numeral 10 will be described.

More specifically, the golf ball retrieval apparatus 10 of the instant invention essentially comprises a rectilinear framework 11, such as illustrated in FIG. 1, to include a right frame leg 12 spaced from and parallel a left frame leg 13 in a coextensive relationship. A forward frame leg 14 is spaced from and parallel a rear frame leg 19 that are in turn orthogonally oriented relative to the right and left frame legs 12 and 13. A mounting leg 15 extends orthogonally relative to the forward frame leg and is medially intersected relative thereto, and is formed with a forward terminal bifurcated leg end 16 to receive a latch pin 17 for securement of the organization relative to a desired tow vehicle such as a tractor and the like (not shown). A central frame leg 18 arranged longitudinally aligned with the mounting leg 15 orthogonally bisects the forward and rear frame legs 14 and 19 respectively and is arranged parallel and medially of the right and left frame legs 12 and 13. A right axle 20 and a left axle 21 are arranged adjacent to and parallel the rear frame leg 19 and include respective right and left axle supports 20*a* and 21*a* rotatably mounting the right and left axles in a coaxially aligned relationship parallel to the rear frame leg 19. A right wheel 28 and a left wheel 29 are mounted respectively to the outer terminal ends of the right and left axles exteriorly of the right and left frame legs. Extending between respective right frame leg 12 and the central frame leg 18 is a right fabric first web 22 extending forwardly of the right axle 20, with a left fabric first web 23 extending forwardly of the left axle 21 between the central frame leg 18 and the left frame leg 13. A right fabric second web 24 extends upwardly relative to the right fabric first web 22, with a left fabric second web 25 extending upwardly relative to the left fabric first web 23. The right and left fabric first webs 22 and 23 define respective right and left pockets to receive golf balls projected thereto from a forwardly oriented set of respective right and left paddle blades 34 and 35, to be described in more detail below.

The right guide plate 26 extends forwardly and downwardly relative to a forward edge of the right fabric first web 22, with a left guide plate 27 extending forwardly and downwardly relative to the left fabric first web 23, wherein the right and left guide plates 26 and 27 are coplanar relative to one another, and each include respective right and left guide plate chute side walls 26*a* and 27*a* to maintain guidance of golf balls onto the chutes into the rearwardly oriented web pockets. The guide plates 26 and 27 extend downwardly positioned in a predetermined spaced relationship relative to the drive shaft axle 31 that is oriented in a parallel spaced relationship relative to the forward frame leg 14. The right and left paddle blades 34 and 35 are defined by a predetermined width substantially equal to the predetermined spacing defined between the guide plates 26 and 27 relative to the drive shaft axle 31. The drive shaft axle 31 includes a drive shaft axle pulley 32 coplanar with a right axle pulley 30 that is fixedly mounted relative to the right axle 20 to include a drive belt 33 to effect simultaneous rotation of the drive shaft axle 31 upon rotation of the right wheel 28. Right paddle blades 34 and left paddle blades 35 are mounted respectively between the central frame leg 18 and the respective right and left frame legs 12 and 13 in an equally spaced relationship about the drive shaft axle 31. The blades are arranged in a coplanar relationship relative to a drive shaft axle axis defined by the drive shaft axle 31.

A respective right and left caster wheel 36 and 37 are mounted adjacent to and below the forward frame leg 14 to maintain the mounting leg 15 in a spaced relationship relative to an underlying ground surface for the organization when not in use to permit ease of lifting and maneuverability of the organization.

Figure 5:
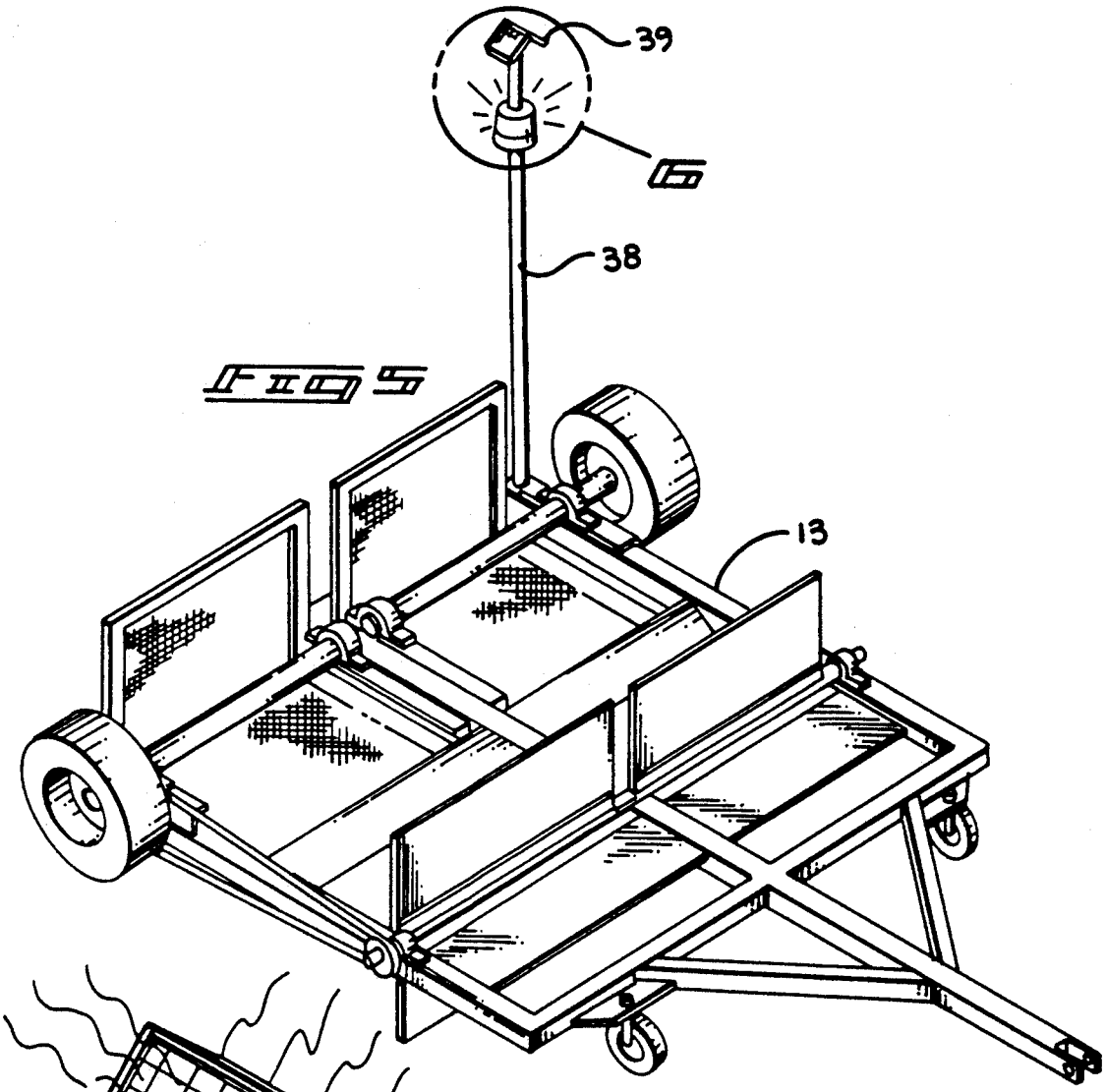
FIG. 5 is an isometric illustration of a modified aspect of the invention.
Figure 6:
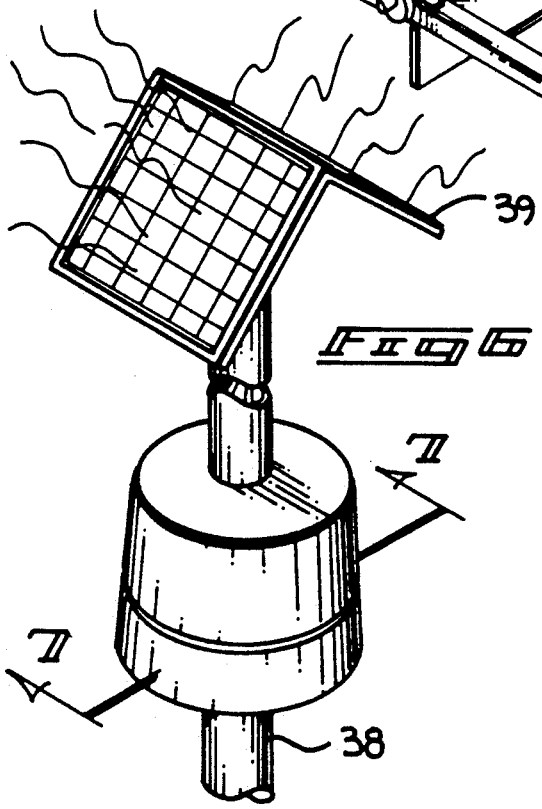
FIG. 6 is an enlarged isometric illustration of section 6 as set forth in FIG. 5.
Figure 7:
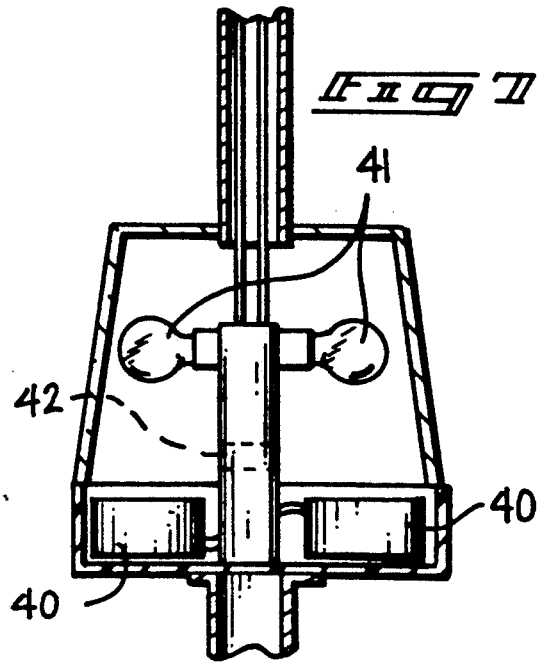
FIG. 7 is an orthographic view, taken along the lines 7—7 of FIG. 6 in the direction indicated by the arrows.

Reference to FIGS. 5–7 illustrate the use of a support post 38 mounted orthogonally relative to the rectilinear framework 11, including a plurality of solar panels 39 in cooperation with solar collectors 40 to effect selective illumination of illumination bulbs 41 contained within a housing and operative through a flash unit 42 to activate flashing of the unit to provide enhanced visual orientation of the organization during use.

The organization as set forth in FIGS. 8 and 9 further illustrate the use of containers 44 mounted upon a support plate 43 that is positioned between the right and left fabric first webs 22 and 23 and the rear frame leg 19. The containers 44 are arranged to provide for storage of golf balls contained within the pockets defined by the first right and left fabric webs 22 and 23 defined by the modified framework 11*a*.

The blades 34 and 35, as illustrated in the modified organization in the FIGS. 8 and 9, include a series of threaded, spaced bores 46 mounted into each of the blades directed into the blades from the blades' outer edges 45. The blades outer edges 45 include the threaded spaced bores 46 to include threaded plugs 47 to be positioned therewithin to permit insertion of the spring fingers 48 within each plug. Each of the spring fingers includes a polymeric "U" shaped extension 49. The spring fingers 48 are themselves rigid, and wherein the polymeric "U" shaped extensions are of a generally resilient construction and extend toward the forward frame leg 14 to permit their reflection and enhance projection of golf balls as the organization is directed through turf and grass. Should the organization be used relative to an underlying rigid surface, such as concrete and the like, the plugs are removed from their associated bores relative to each of the blades to permit use of the blades alone in the retrieval of golf ball members.

It is noted that standardized dimension of a golf ball is 1.75 inches and accordingly, the threaded spaced bores 46 are spaced apart a predetermined distance that is less than 1.75 inches to insure engagement of a plurality of the spring fingers and the associated forwardly projecting "U" shaped extensions relative to each golf ball engaged by the fingers.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf ball retrieval apparatus, comprising, a continuous rectilinear framework, wherein the rectilinear framework includes a right frame leg spaced from, parallel, and coextensive to a left frame leg, and a forward frame leg spaced from, parallel to, and coextensive with a rear frame leg, and a mounting leg orthogonally and fixedly intersecting the forward frame leg extending forwardly of the forward frame leg, with the mounting leg including a forward distal end, with the forward distal end including securement means for securement of the mounting leg to a transport vehicle, and a central frame leg longitudinally aligned with the mounting leg oriented medially of and coextensive with the right frame leg and the left frame leg arranged in a parallel relationship, and a right axle rotatably mounted to the central frame leg and the right frame leg, and a left axle rotatably mounted to the central frame leg and the left frame leg in a coaxially aligned relationship relative to the right axle in a spaced relationship relative to the right axle in a spaced parallel relationship relative to the rear frame leg, wherein the right axle includes a right wheel mounted to an outer distal end of the right axle exteriorly of the right frame leg, and a left wheel rotatably mounted to an outer distal end of the left axle exteriorly of the left frame leg, and a right axle pulley mounted to the right axle, and a drive shaft axle spaced forwardly of and parallel to the right axle and the left axle extending orthogonally between the right frame leg and left frame leg adjacent the forward frame leg, the axle rotatably mounted to the right frame leg and the left frame leg, and wherein the drive shaft axle includes a plurality of paddle blades mounted to the drive shaft axle, and a drive shaft axle pulley mounted to the drive shaft axle coplanar with the right axle pulley, and a drive belt in operative engagement with the right axle pulley and the drive shaft axle to effect rotation of the drive shaft axle upon rotation of the right axle, and including a right fabric first web pocket mounted between the right frame leg and the central frame leg adjacent the right axle extending forwardly thereof, with a left fabric first web pocket mounted between a central frame leg and the left frame leg extending forwardly thereof, and a right fabric second web extending upwardly relative to the right fabric first web, and a left fabric second web extending upwardly relative to the left fabric first web, and a right guide plate extending from the right fabric first web forwardly and downwardly thereof, with a left guide plate extending from the left fabric first web forwardly and downwardly thereof, wherein the right guide plate and left guide plate each include respective right and left guide plate side walls, and the right guide plate and left guide plate are spaced from the drive shaft axle a predetermined spacing to direct golf balls from the paddle blades to the right and left web pockets.

2. An apparatus as set forth in claim 1 wherein each of the paddle blades are defined by a predetermined width substantially equal to the predetermined spacing, and the paddle blades include a plurality of right paddle blades mounted in a spaced relationship about the drive shaft axle between the central frame leg and right frame leg, and a plurality of left paddle blades equally spaced about the drive shaft axle between the central frame leg and the left frame leg.

3. An apparatus as set forth in claim 2 including a right caster wheel and a left caster wheel mounted to the forward frame leg forwardly of the right paddle blades and the left paddle blades respectively.

4. An apparatus as set forth in claim 3 wherein each of the paddle blades includes a paddle blade outer edge, each of the paddle blade outer edges include a plurality of spaced bores, the bores orthogonally oriented relative to a drive shaft axle axis defined by the drive shaft axle, wherein each of the paddle blades are arranged in a coplanar relationship relative to the drive shaft axle axis, wherein each of the paddle blades extend radially relative to the drive shaft axle, and the bores each are arranged to receive a plug member, each plug member includes a rigid finger spine coaxially directed relative to each plug member and bore, wherein each finger spine includes a polymeric "U" shaped flexible extension extending forwardly of each finger spine towards the forward frame leg to effect capture of a single golf ball of said golf balls by the spring finger spines and the "U" shaped extensions.

5. An apparatus as set forth in claim 4 wherein each of the spring finger rigid spines are spaced apart a predetermined distance less than 1.75 inches.

* * * * *